United States Patent [19]

Friedrichs

[11] 4,155,676

[45] May 22, 1979

[54] HYDRAULIC WALKING ROOF-SUPPORT FRAME

[75] Inventor: Hans-Otto Friedrichs, Wuppertal, Fed. Rep. of Germany

[73] Assignee: Hermann Hemscheidt Maschinenfabrik GmbH & Co., Wuppertal, Fed. Rep. of Germany

[21] Appl. No.: 904,287

[22] Filed: May 9, 1978

[30] Foreign Application Priority Data

Jun. 18, 1977 [DE] Fed. Rep. of Germany ..... 2727414

[51] Int. Cl.[2] ..... E21D 17/10

[52] U.S. Cl. ..... 405/293

[58] Field of Search ..... 405/288, 293, 295; 61/45 D

[56] References Cited

FOREIGN PATENT DOCUMENTS 2124244 11/1972 Fed. Rep. of Germany ..... 61/45 D 314907 9/1971 U.S.S.R. ..... 61/45 D

*Primary Examiner*—Jacob Shapiro

*Attorney, Agent, or Firm*—Berman, Aisenberg & Platt

[57] ABSTRACT

An hydraulic walking roof-support frame for a coal mine has a roof support assembly comprising a main support and an auxiliary support pivotally connected to the main support for pivoting about a horizontal axis through an angle of 180°. The auxiliary support is caused to pivot by a pair of hydraulically operated extensible and retractable jacks connected between the main support and the auxiliary support, the pivot points where the jacks are connected to the auxiliary support being angularly spaced apart relative to the axis of pivoting of the auxiliary support whereby when (during pivoting of the auxiliary support) one jack is in a "dead center" position the other jack can still pivot the auxiliary support permitting remote control thereof.

12 Claims, 5 Drawing Figures

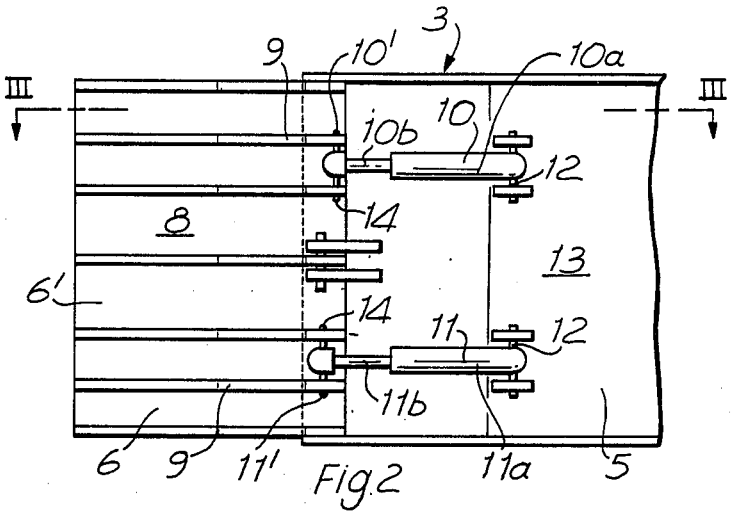
Fig.2
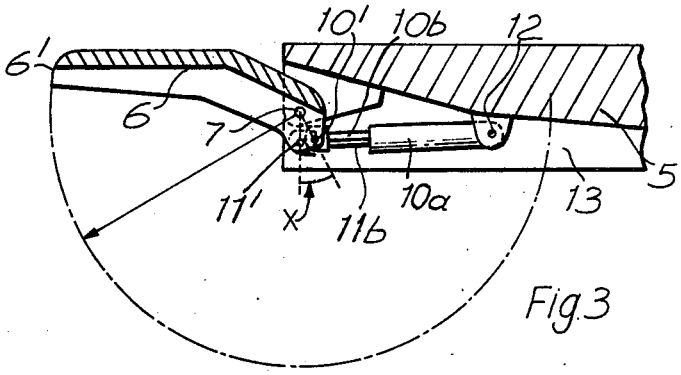
Fig.3
Fig.4
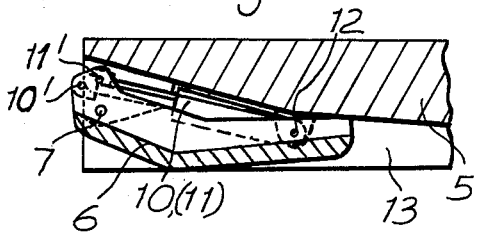

HYDRAULIC WALKING ROOF-SUPPORT FRAME

This invention relates to an hydraulic walking roof-support frame for use in supporting a mine roof at a working face (for example, a coal face) the roof-support frame comprising a base, a roof support assembly, and extensible and retractable hydraulic props extending between the base and the roof support assembly for urging the roof support assembly against a roof.

It has already been proposed to construct the roof support assembly of the frame in two parts, namely a main support connected to the upper ends of the props, and an auxiliary support mounted on the main support for pivotal movement about a generally horizontal axis. In this proposal the auxiliary support can be pivoted through an angle of about 180° between a stowed position and an operative position. In its stowed position the auxiliary support lies folded back beneath the main support in contact with the underside of the main support. In its operative position the auxiliary support extends outwardly from the main support to assist in supporting a roof, and if the roof is flat the auxiliary support will form a coplanar extension of the main support. If, however, the roof is uneven, the auxiliary support, when in its operative position, may slope upwardly or downwardly from the main support.

In the said proposal the auxiliary support is pivoted between its positions by means of an extensible and retractable hydraulic jack pivotally connected at one end to the auxiliary support at a point mid-way between the free edge of the auxiliary support and the said horizontal pivot axis. The other end of the jack is pivotally connected to one of the props.

In order to move the auxiliary support from its operative to its stowed position, the jack is retracted until the auxiliary support has pivoted through about 130° . At this time the pivot points at the ends of the jack are in line with the pivot axis of the auxiliary support, and the jack itself lies in the plane of the auxiliary support in an opening in the support, such opening extending from the pivot connection between the jack and the auxiliary support to the free edge of the auxiliary support. This is a "dead centre" position in which the jack cannot exert a pivoting force on the auxiliary support. From this "dead centre" position the auxiliary support is pushed manually towards its stowed position, whereupon the jack can be extended to urge the auxiliary support against the underside of the main support.

The proposal described above has three serious disadvantages. Firstly, operation of the auxiliary support cannot be entirely remote controlled because it needs to be manually assisted through its "dead centre" position. Secondly, because the jack can be connected only to a prop outer cylinder rather than to a prop piston, the prop to which the jack is connected must be of the kind having its cylinder at the top, or otherwise the jack must be very long. Problems can also occur if the props slope. Thirdly, the provision of the opening in the auxiliary support (through which opening the jack passes as the auxiliary support passes through its "dead centre" position) means that when the auxiliary support is in its operative position the roof is unsupported in the region of the opening.

The present invention has been devised with these considerations in mind, and a preferred embodiment of the invention overcomes all three of the above disadvantges.

In its broadest aspect, an hydraulic walking roof-support frame according to the invention comprises a base assembly, a roof support assembly, and extensible and retractable hydraulic props extending between the roof support assembly and the base assembly for raising and lowering the roof support assembly, the roof support assembly comprising a main support connected to upper ends of the props and an auxiliary support mounted on the main support for pivotal movement about a generally horizontal axis between a stowed position in which it lies folded back beneath the main support and an operative position in which it extends outwardly from the main support in a position to assist in supporting a roof, the auxiliary support being movable between its said positions by means of a pair of hydraulically operated retractable and extensible jacks pivotally connected at one end thereof to the auxiliary support and pivotally connected at their other end to another part of the frame, the respective positions at which the jacks are pivotally connected to the auxiliary support being angularly spaced from one another relative to the said pivot axis of the auxiliary support.

It will be appreciated that, because the respective positions where the jacks are pivotally connected to the auxiliary support are angularly spaced apart relative to the pivot axis of the auxiliary support, the two jacks can never be in their "dead centre" positions simultaneously. Therefore, when one jack is in its "dead centre" position, the auxiliary support can be moved by means of the other jack, thus enabling operation of the auxiliary support to be fully remote controlled.

In a preferred embodiment of the invention the said another part of the frame to which the jacks are connected comprises the main support. By connecting the jacks to the main support instead of one of the props as in the case of the prior proposal, the various problems described above associated with connecting a jack to a prop are avoided.

It is preferred to connect the jacks to a part of the auxiliary support remote from a free edge of such support, the arrangement being such that when the auxiliary support is in its operative position the pivot axis of the auxiliary support lies above the pivotal connections between the jacks and the auxiliary support. By connecting the jacks as described instead of as in the prior proposal, the jacks will not pass through the auxiliary support as such support pivots, so that there is no need to provide an opening in the auxiliary support.

A preferred embodiment of the invention will now be described by way of example with reference to the accompany drawings, in which:

FIG. 2 is a plan view of the roof-support assembly as seen from the underside thereof;

FIG. 3 is a side view in cross-section taken on the line II—II in FIG. 2, but showing only the roof support assembly, an auxiliary support of such assembly being shown in a different position from that shown in FIG. 1;

FIG. 4 is a view similar to FIG. 3 but showing the auxiliary support in another position.

Figure 1:
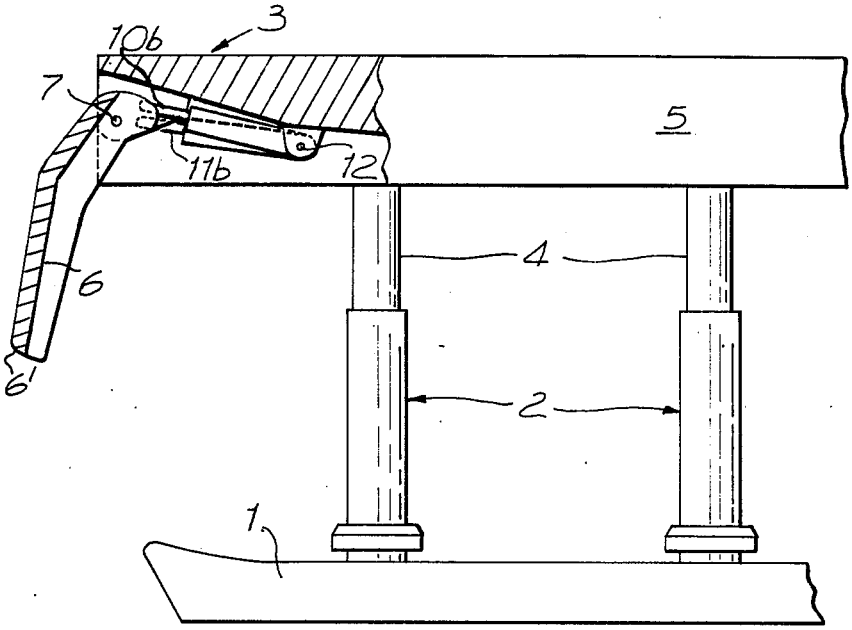
FIG. 1 is a side view in partial cross-section of a part of a walking roof-support frame according to the invention, the view showing a roof support assembly supported from a base assembly via props.

FIG. 1 shows an hydraulic walking roof-support frame having a base assembly comprised by a one-piece base 1 on which hydraulically extensible and retractable props 2 are mounted. Instead of the arrangement shown, the base assembly could comprise individual base shoes, one on the bottom of each prop. A roof support assembly 3 is mounted on the pistons 4 of the props 3, the props serving for raising and lowering the roof support assembly and for urging it against a roof (not shown).

The roof support assembly 3 comprises a main support 5 mounted directly on the pistons 4, and an auxiliary support 6 mounted on the main support 5 for pivotal movement about a generally horizontal axis 7 between a stowed position and an operative position. In its stowed position FIG. 4 the auxiliary support 6 lies folded back beneath the main support 5 in contact with the underside thereof. In its operative position (FIGS. 1 and 2) the auxiliary support 6 extends outwardly from the main support to assist in supporting a roof. If the roof is flat, the auxiliary support will lie in an end position in line with the main support, i.e. forming a co-planar extension of the main support, but of course if the roof is uneven the auxiliary support 6 may slope up or down from the main support 5.

As shown in FIG. 2, the auxiliary support 6 is comprised by a plate 8 braced or supported by a number of parallel bars or beams 9. A pair of hydraulically retractable and extensible jacks 10 and 11 serve to pivot the auxiliary support between its extreme positions and to bias the auxiliary support 6 continuously into engagement with the roof when the auxiliary support is in its operative position.

As best shown in FIG. 2, the cylinders 10*a* and 11*a* of the jacks 10,11 are pivotally connected to the main support 5 at locations 12 disposed in a recess 13 in the underside of the main support 5. The piston rods 10*b*,11*b* of the jacks 10,11 are pivotally connected to the auxiliary support at respective axes 10',11'. It will be seen that the pivot axes 10',11' do not lie between the pivot axis 7 and the free edge 6' of the auxiliary support 6, but lie instead on the side of axis 7 which is remote from edge 6'. The pivot pins 14 which connect the piston rods 10*b*,11*b* to the auxiliary supports are ech mounted by a pair of the bracing beams 9.

As shown in FIG. 3, although the axes 10',11' are spaced by mutually the same distance from the pivot axis 7 of the auxiliary support 6, the axes 10' and 11' form between them an angle X with the axis 7. The angle X may be between 25° and 35°, for example 30°, but this is not critical and angles falling outside the quoted range may be satisfactory. As shown in FIG. 3, axis 11' is generally vertically below axis 7 when the support 6 is in its operative position.

Figure 5:
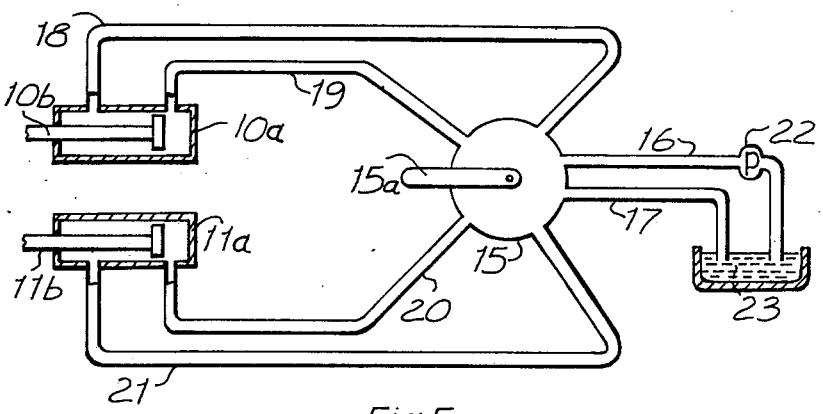
FIG. 5 is a diagrammatic view of a hydraulic circuit for operating jacks which serve to pivot the auxiliary support.

FIG. 5 shows an hydraulic circuit for controlling extension and retraction of the jacks 10,11. The circuit comprises a valve assembly 15 details of which are not shown because the valve assembly is conventional and its construction forms no part of the present invention. Connected to the valve assembly are six fluid lines 16 to 21. Line 16 is an inlet to the valve assembly 15 and it includes a pressure pump 22 which delivers fluid to the valve assembly 15 from a reservoir 23. Line 17 is a return line from the valve assembly 15 to the reservoir 23. Lines 18 and 19 communicate with the cylinder 10*a* of jack 10, one on each side of the piston in the cylinder. Similarly, lines 20 and 21 communicate with the cylinder 11*a* of jack 11, one on each side of the piston thereof. The valve assembly 15 includes a control member 15*a* movable to various positions for controlling the flow in the lines 16 to 21.

Operation of the apparatus described above will now be explained. When the auxiliary support 6 is in its stowed position (FIG. 4) the control member 15*a* of valve assembly 15 will be in a first position connecting lines 19 and 20 to the pressure line 16, and connecting lines 18 and 21 to the reservoir return line 17. Thus, both jacks 10 and 11 are extended to bias the auxiliary support into contact with the underside of the main support 5.

When it is desired to move the auxiliary support 6 to its operative position, the control member 15*a* is moved to a second position in which both lines 18 and 21 are connected to the pressure line 16, whereas lines 19 and 20 are connected to the return line 17. Thus causes the two jacks to retract simultaneously, thus causing the auxiliary support to pivot clockwise to a position (very slightly beyond that shown in FIG. 1) in which jack 11 has passed through its "dead centre" position (axes 7,11' and 12 in line), but jack 10 has not yet reached its "dead centre" position (axes 7,10' and 12 in line). The control member of valve assembly 15 is then turned to a third position so connecting lines 16 to 21 that whilst jack 10 is still biased to retract, jack 11 is biased to extend. This will cause the auxiliary support 6 to pivot further clockwise to carry jack 10 beyond its "dead centre" position. The control member 15*a* of valve assembly 15 is then returned directly to its first position (without passing through its second position) in which both jacks are biased to extend. The auxiliary support is thus pivoted to its operative position in contact with a roof, and will be urged against the roof by the force of both jacks.

The manner in which the auxiliary support is returned to its stowed position will be described briefly. The control member 15*a* will be moved to its second position described above in which both jacks retract to pivot the auxiliary support anti-clockwise to a position just short of that shown in FIG. 1. The control member 15*a* will then be moved to a fourth position in which jack 11 is still biased to retract, but jack 10 is biased to extend. This causes the auxiliary support to pivot further anticlockwise to a position in which both jacks are moved beyond their "dead centre" positions. Control member 15*a* is then returned directly to its first position, so that both jacks extend and bias the auxiliary support 6 against the underside of the main support 5.

In a practical arrangement of a valve assembly 15, there may be several "first positions" of the control member 15*a* (i.e. positions in which both jacks are extended) to enable the control member to be moved direct to a first position from another position by-passing undesired positions.

The above description of the operation of the jacks assumes that when the auxiliary support is returned from its operative position to its stowed position no use is made of the force of gravity acting on the auxiliary support to carry the jacks beyond their "dead centre" positions. However, if in an alternative embodiment use is made of the force of gravity acting on the auxiliary support to carry the jacks beyond their "dead centre" positions, then the valve assembly could be modified accordingly.

The frame described above will support a mine roof at the work face, and will be pivoted to its stowed position to allow a cutter to pass, whereafter the auxiliary support will be returned to its operative position.

What is claimed is:

1. An hydraulic walking-roof support frame comprising a base assembly, a roof support assembly, jack means, and extensible and retractable hydraulic props extending between the roof support assembly and the base assembly for raising and lowering the roof support assembly, the roof support assembly comprising a main support connected to said props and an auxiliary support mounted on the main support for pivotal movement about a generally horizontal axis between a stowed position in which it lies folded back beneath the main support and an operative position in which it extends outwardly from said main support in a position to assist in supporting a roof, said jack means serving to move the auxiliary support between its said positions and comprising first and second hydraulically operated retractable and extensible jacks pivotally connected at one end thereof to the auxiliary support and at the other end thereof to another part of said support frame, the respective positions at which the jacks are pivotally connected to the auxiliary support being angularly spaced from one another relative to the said pivot axis of the auxiliary support.

2. An hydraulic walking roof-support frame as claimed in claim 1, in which said another part of said support frame comprises said main support.

3. An hydraulic walking roof-support frame as claimed in claim 2, in which each said jack is pivotally connected to said main support at location disposed in a recess in said main support.

4. An hydraulic walking roof-support frame as claimed in claim 1, in which said jacks are connected to a part of said auxiliary support remote from a free edge of such support, the arrangement being such that when said auxiliary support is in its said operative position said pivot axis of the auxiliary support lies above the pivotal connections between the jacks and the auxiliary support.

5. An hydraulic walking roof-support frame as claimed in claim 4, in which when the auxiliary support is in a said operative position in line with the main support, the point at which one of the jacks is connected to the auxiliary support is vertically below the pivot axis of the auxiliary support, whereas the other jack is connected to the auxiliary support at a position to that side of the pivot axis of the auxiliary support which is remote from its free edge.

6. An hydraulic walking roof-support frame as claimed in claim 1, in which said jacks are connected to the auxiliary support at positions equidistant from said pivot axis of such support.

7. An hydraulic walking roof-support frame as claimed in claim 1, in which the angular spacing between the positions where the jacks are connected to the auxiliary support is about 30°.

8. An hydraulic walking roof-support frame as claimed in claim 1, and further comprising an hydraulic circuit for operating said jacks, said hydraulic circuit including a valve assembly having a control member, said control member having a position in which both jacks are extended simultaneously.

9. An hydraulic walking roof support frame as claimed in claim 8, in which said control member can be moved to a further position in which said first jack only is extended.

10. An hydraulic walking roof-support frame as claimed in claim 9, in which said control member can be moved to another position in which said second jack only is extended.

11. An hydraulic walking roof-support frame as claimed in claim 8, in which said control member has a position in which both said jacks are retracted.

12. An hydraulic walking roof-support frame as claimed in claim 1, in which the auxiliary roof support comprises a plate, beams bracing said plate, each said jack being pivotally connected to a pair of said beams.

* * * * *